United States Patent [19]

Klem

[11] 4,029,191

[45] June 14, 1977

[54] VARIABLE SPACING PRINTING APPARATUS

[75] Inventor: Edward J. Klem, Las Vegas, Nev.

[73] Assignees: Angelina M. Klem; Robert B. Pahor, both of Las Vegas, Nev. ; part interest to each

[22] Filed: May 1, 1975

[21] Appl. No.: 573,617

[52] U.S. Cl. ..... 197/2; 197/84 R

[51] Int. Cl.[2] ..... B41J 1/16; B41J 19/00; B41J 3/28

[58] Field of Search ..... 197/6, 6.2, 2, 84 R, 197/84 A, 84 B

[56] References Cited

UNITED STATES PATENTS

| | | | |
|---|---|---|---|
| 2,115,692 | 4/1938 | Thorn | 197/2 |
| 2,670,831 | 3/1954 | Barrett et al. | 197/2 |
| 2,873,013 | 2/1959 | Theine et al. | 197/84 B |
| 2,986,256 | 5/1961 | Weaver | 197/84 B |
| 3,215,245 | 11/1965 | Theine et al. | 197/2 |
| 3,288,263 | 11/1966 | Salto | 197/84 R |
| 3,455,430 | 7/1969 | Schweizer | 197/84 R |

*Primary Examiner*—Edgar S. Burr
*Assistant Examiner*—William Pieprz

[57] ABSTRACT

A printing apparatus comprises a plunger rod for actuating type in a type case, an adjustable stepper rod for determining advancement of a platen on which printing paper is secured, a handle for depressing and elevating the plunger and stepper rods, a biased pawl cooperating with the stepper rod for determining the amount of advancement of the platen and a cooperating rack or ratchet member for engaging the pawl and advancing the platen.

12 Claims, 4 Drawing Figures

VARIABLE SPACING PRINTING APPARATUS

BACKGROUND OF THE INVENTION

Printing apparatus used and known heretofore for lettering and printing signs, advertisements, announcements, placards, and the like have involved the use of rather expensive and somewhat bulky devices incorporating hydraulic mechanisms. Repairs on such apparatus are also usually time consuming and rather expensive whereby the devices are simply not usually economical for many small businesses.

It is an object of this invention to provide a relatively simple and inexpensive apparatus for printing. It is also an object of the invention to provide a device which can be simply operated and is relatively easy to repair, even without the necessity of hiring expert or highly specialized personnel. These as well as other objects will be evident from the detailed description of the invention.

SUMMARY OF THE INVENTION

The printing apparatus of the present invention incorporates a first reciprocating rod having a lower end for being received in one of a plurality of type case cover orifices which actuates or depresses a printing key, a second reciprocating rod having a lower end for being received in one of a plurality of type case cover orifices for determining advancement of a platen, a biased hinged pawl member cooperating with the second rod, means for adjusting elevation of the second rod for selecting the extent of retraction of the pawl member, handle means for alternately depressing and elevating the first and second rods, movable means for engaging the pawl member and an arm member secured thereto for advancing a movable platen, whereby the pawl member is retracted along the pawl engaging means during depressing or downward movement of the second rod and advances the engaging means and platen as the second rod is elevated.

In a preferred embodiment, the movable pawl engaging means comprises a ratchet bar having a plurality of teeth along a surface thereof for engaging the pawl and a second rod elevation adjusting means comprises a sleeve secured to a block member on which the biased pawl is hingedly secured. The second rod, sleeve, and block member move downwardly together whereby initial second rod elevation determines the distance of downward travel and limits the extent of retraction of the pawl and subsequent advancement of the ratchet and platen when the handle and second rod are elevated. The sleeve extends around a portion of the second rod and a slanted slot in which a pin secured to the second rod is received with the slot terminating at opposite high and low ends whereby the elevation of second rod is adjusted by rotating the rod and concomitantly along the slot. Other features as well as operation of the apparatus will be explained more fully hereinafter.

DETAILED DESCRIPTION OF THE INVENTION

Figure 1:
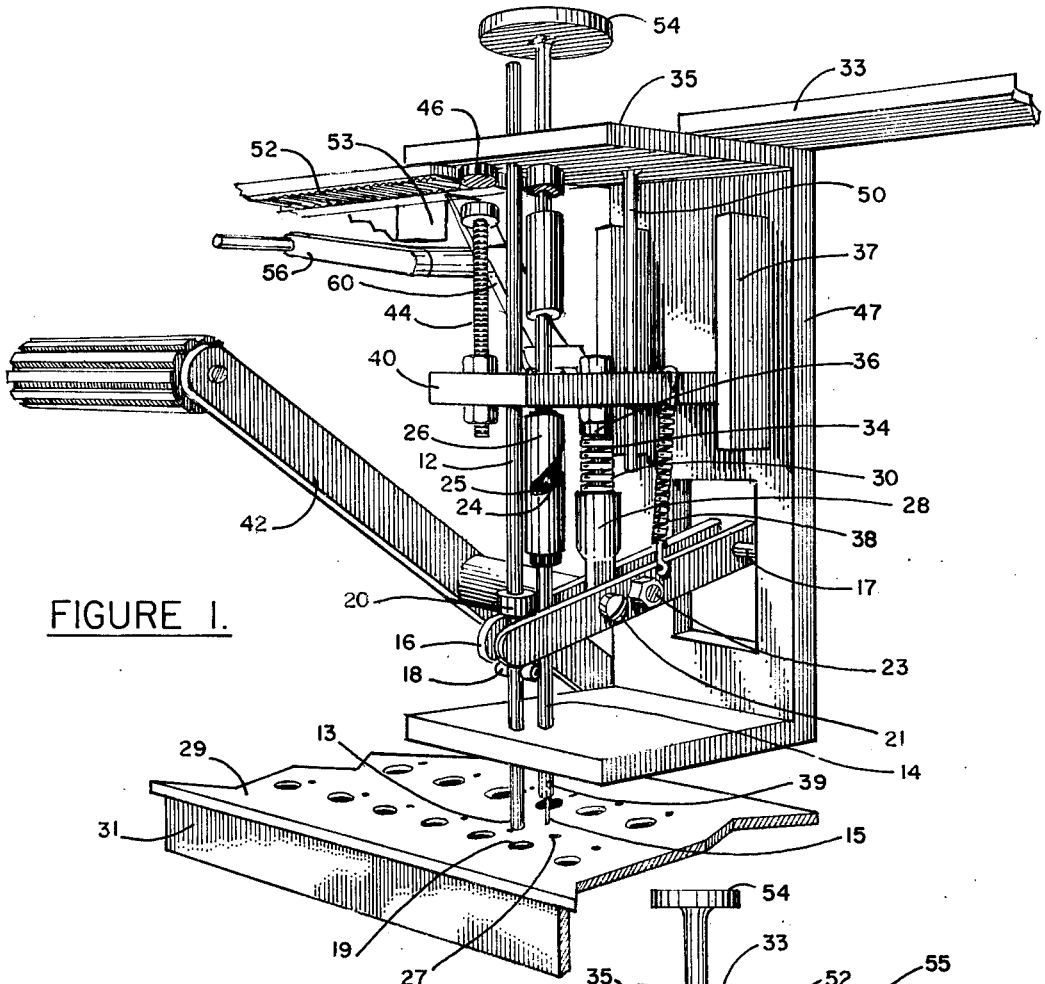
FIG. 1 is a perspective view of the printing apparatus of the invention.
Figure 2:
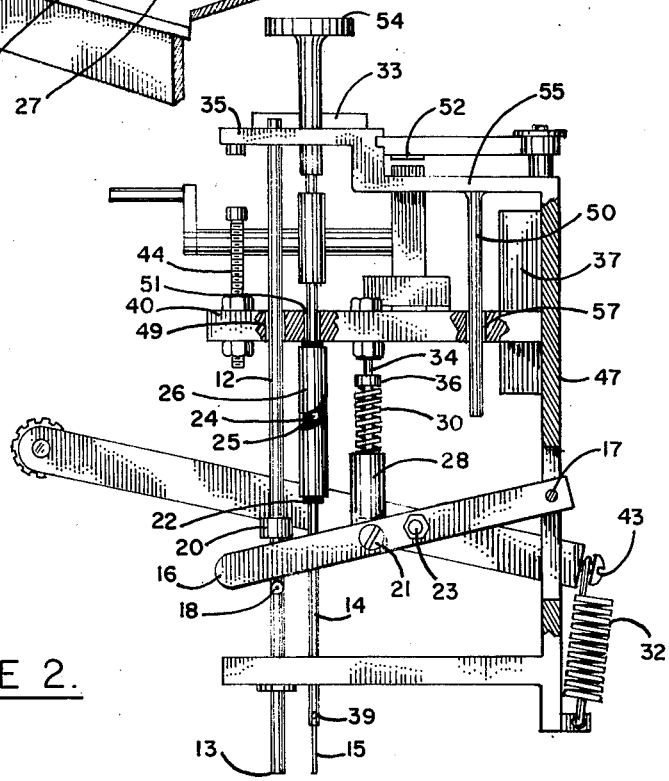
FIG. 2 is a side elevation of the apparatus as shown in FIG. 1, partially in section.

Observing first FIGS. 1 and 2, there is illustrated the printing apparatus having a plunger rod 12 and a space control rod 14. These rods are moved up and down reciprocally as the printing operation is carried out. Preferably, the rods are substantially parallel and extend vertically in the device and move substantially along their vertical axis during operation. The rods are moved reciprocally by an operator moving handle 42 upwardly and downwardly and which handle movement operates bracket 16. This bracket is secured pivotally at one end on bracket pivot 17 which is secured on frame post 47 while handle 42 pivots at its rear end on pivot 43, also secured on frame post 47. The bracket shown is bifurcated but that feature is not critical. A spring 32 extending between the handle end and the frame post is biased so as to urge the handle in a fully elevated position. Thus, as the handle is moved upwardly and downwardly or elevated and depressed and is attached to bracket 16 by a pivot pin 23 extending through the bracket and handle, the bracket is concomitantly moved upwardly and downwardly. Plunger rod 12 has means for being moved reciprocally upwardly and downwardly as the handle and bracket are so moved and which means comprises a collar 20 and pin 18 both secured to the plunger rod. In the example illustrated, the collar is adjustable along the plunger rod by suitable means such as a set screw threadedly engaging the collar and which may be loosened so that the collar can be moved to any position on the plunger rod and secured. Likewise, a similar collar may be substituted for pin 18 and adjusted to any position along the plunger rod so that elevation adjustment of the plunger rod to any height desired may be made. It will be understood that collar 20 and pin 18 are positioned as to contact the upper and lower surfaces of bracket 16 whereby, as the bracket is urged upwardly, it pushes against the lower collar surface to elevate the plunger rod or, on the downward stroke, against pin 18 to depress the plunger rod.

Space control rod 14 is also moved upwardly or downwardly as the handle and bracket are so moved but in an indirect manner. Extending from bracket 16 is connecting member 28 pivotally attached to the bracket at post 21 so that the connecting member is pushed upwardly as the bracket is elevated and pulled downwardly as depressed by the handle. Lying against the upper surface of the connecting member is a buffer spring 30 secured to an annular push member 36 through which member and spring extends guide rod 34. The guide rod passes through an oversized bore in connecting member 28 and is secured at its upper end to block member 40. Thus, the connecting member, spring and push member are free to move along guide rod 34 independent of the latter.

Block member 40 extends outwardly from guide member 37 the latter having a slot or track in which the end of the block member is received and guided during up and down movement therealong. Block member 40 has a pair of guide slots 49 and 51 bored therethrough for slidably receiving plunger rod 12 and space control rod 14 respectively. Thus, these two rods can be moved within the respective slots independently of the movement of the block member since the slots are oversized as compared to the cross-sectional dimensions of the rods. Accordingly, as plunger rod 12 is pushed upwardly or pulled downwardly by handle 42 and bracket 16, this rod movement does not cause the movement of the rod in the block as previously explained.

The upper end of sleeve 26 is attached to block member 40 so that any movement of either one of these parts is translated to the other. Sleeve 26 is hollowed and extends around rod 14 along a portion of its length so that the rod can be moved or turned within the sleeve. The sleeve includes a guide slot 25 which extends angularly between a low slot end and a high slot end. Secured to rod 14 is a pin 24 which is received and extends through guide slot 25 in sleeve 26 so that the slot acts as a track for the pin. Since guide slot 51 in block 40 is oversized with respect to the exterior dimensions of rod 14 as is the diameter of the interior of sleeve 26, the rod can be turned or rotated about its axis within these two members. A handle 54 is provided at the upper end of rod 14 for this purpose. Thus, as rod 14 is rotated, pin 24 will be guided within slot 25 causing the rod to be elevated or lowered relative to sleeve 26 and block 40, the purpose for which will be more fully explained hereinafter.

Figure 3:
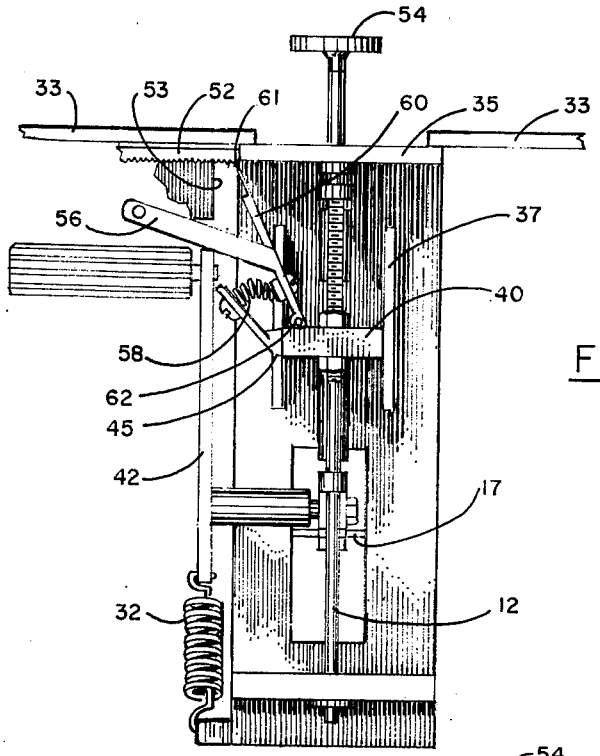
FIG. 3 is a front elevation of the apparatus.
Figure 4:
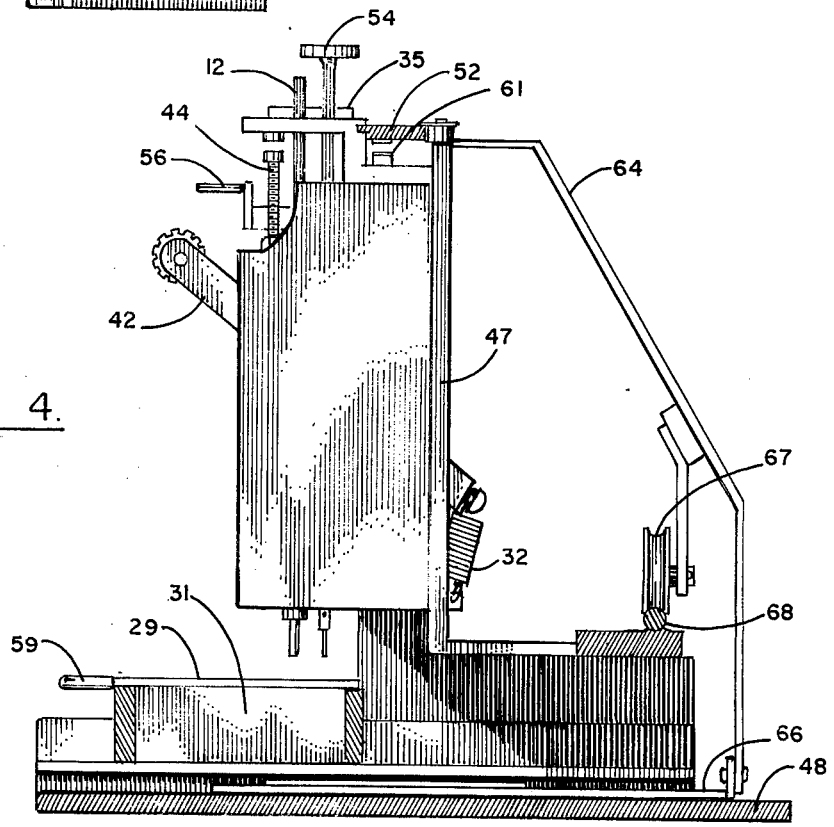
FIG. 4 is a back view of the apparatus.

Observing now also FIG. 3, there is shown the means for advancing a platen on which a paper or card or other surface which is to be printed is secured for lettering and whereby desired spacing between adjacent letters is achieved. This means comprises in the preferred embodiment, an elongated ratchet member or rack 52 having a lower surface with a plurality of regularly spaced teeth extending therealong. The ratchet member is movable along a track formed in upper horizontal frame member 33. Advancement of the ratchet during the printing operation is from right to left observing FIG. 3 and secured to the ratchet is one or more arm members 64 which are also secured to the platen as shown in FIG. 4. In this manner movement of the ratchet results in concomitant movement of the platen during the printing process. A pawl 60 secured to block 40 at its lower end on hinge 62 so that the pawl will pivot about an arc from right to left and vice versa observing FIG. 3. The pawl has an upper edge surface 61 for engaging the teeth of rack 52. An arm 45 extends from block 40 and to which arm is secured a biasing member in a form of a spring 58 for urging the pawl to the right in FIG. 3, i.e., toward the rods 12 and 14 as its swings or rotates on hinge 62. A stop plate 53 is secured to frame member 33, preferably adjustably, for limiting the movement of pawl 60. Also attached to pawl member 60 is handle 56 for independently moving the pawl member by an operator.

Referring also again to FIGS. 1 and 2, there is shown a plate 35 secured to upper frame member 33 through which rods 12 and 14 extend. For this purpose, holes or slots are bored through the plate, being at least somewhat oversized from the exterior dimensions of the rods so that they are free to travel upwardly or downwardly within the plate or otherwise be rotated therein. In a further preferred embodiment, a composition member 22 which frictionally engages the interior surface of hollow sleeve 26 is provided so that when the rod 14 is rotated within the sleeve, whereby it is elevated or depressed as it is rotated due to travel of pin 24 in slanted slot 25, it will remain in the selected position until it is purposely rotated to a different position by the operator. Suitable compositions include cork, rubber, plastic or any materials which will frictionally but yieldably engage the interior sleeve surface. It has been found, for example, that rubber, which has been oiled, thereby expanding it somewhat, is especially suitable since the expansion will cause the rubber to swell against the interior sleeve surface but at the same time allow it to be rotated thereagainst by an operator grasping handle 54 to turn or rotate the space control rod 14. Also secured to an extension 55 of frame post 47 is a guide rod 50 which extends downwardly therefrom through a slot 57 in block 40. The purpose for guide rod 50 is to further assist in maintaining a substantially horizontal plane of block 40 as it travels upwardly and downwardly. Thus, in addition to rods 12 and 14 which extend through the block in such a manner that they also assist in maintaining block 40 in a horizontal plane position during such travel, guide rod 50 similarly assists in maintaining the proper attitude of the block member at the rear portion.

Observing now also FIG. 4, there is shown a frame portion 48 to which is secured a horizontal guide track 68. Arm 64 is secured at its upper end to rack 52 and to which arm is attached a roller 67 for traveling along guide track 68 and a platen 66 on which a paper on which printing is to be made is secured. Type case 31 having a cover 29 independently moves on suitable rollers and guide tracks both transversely and longitudinally in a horizontal plane. A handle 59 secured at any convenient location on the type case may be grasped by an operator for moving the type case to any desired position for indexing cover orifices with the plunger and spacer rods as the printing operation is carried out.

In operating the printing apparatus of the invention, with a paper, card or other material on which printing is to be made being secured to the upper platen surface, the operator will move or position type case 31 so that one of the orifices 19 is directly below end 13 of plunger rod 12. When this is accomplished, a second orifice 27 will also be located directly beneath end 15 of space control rod 14. The first and second orifices are so located on the type case cover to accomplish this. Each of the first orifices 19 on type case cover 29 is for a different letter or number which is to be printed on the paper secured to the platen. In other words, different orifices are for actuating different letter types. Since type cases as used in this printing apparatus are well known to those skilled in the art, additional detail of the components, design and function will not be set forth in detail herein and since the type case, other than being a component of the overall printing apparatus of this invention is not a separate invention herein. When the proper letter to be printed on the paper secured to the platen has been selected an orifice 19 for that letter positioned directly beneath end 13 of plunger rod 12, the operator will grasp handle 42, which is normally in the upper or elevated position due to biasing spring 32, and pull the handle downwardly. This motion will in turn depress bracket 16 downwardly via pin 23 which extends through both the bracket and the handle pivotally on pin 17 and urges the forward bracket end against pin 18 secured to plunger rod 12. Thus, the plunger rod will be depressed whereby its end 13 will pass through orifice 19 in the type case cover and actuate a printing key to print the selected letter or number onto the paper position on the platen located directly beneath the type case. As plunger rod 12 is pulled downwardly through the oversized slots in block 40 and plate 35, connecting member 28 is also pulled downwardly with brackets 16 since it is attached at post 21 and which downward movement also allows spring 30 and push member 36 to travel downwardly gravitationally along guide rod 34. As this occurs, block 40, rod 14, and sleeve 26 into which rod 14 is engaged via pin 24 and which sleeve is attached to block 40 will simultaneously fall gravitationally of their combined weight. It is understood that rod 14 does not engage bracket 16 and block member 40 only slidably engages guide rod 50 and guide member 37. However, there may optionally be included an auxiliary spring 38 between the block member and bracket to assist in depression of the block member during the downward cycle of the apparatus. The spring may have a tension adjustment feature such as by having one end extend through a collar with a lock nut whereby the length of spring end extending through the collar may be adjusted for varying the tension. In this manner, as handle 42 and bracket 16 are depressed, the spring will pull downwardly against block member 40 and so urge it. As block member 40 is depressed or falls it will come to rest when the lower end 15 of space control rod 14 rests against a surface at a predetermined or fixed level beneath orifice 27. As this depression of block 40 occurs, pawl 60 will also be pulled downwardly and at the time pivots on its hinge 62 while being urged to the right by spring 58. As this occurs, pawl edge 61 passes over a rack 52 which is maintained at a fixed elevation since it is horizontally movably secured in upper frame member 33. The pawl then comes to rest at a stop position when block 40 comes to rest in its downward travel.

Once the letter or number has been printed on the paper secured to the platen due to actuation of the selected type in type case 31, and caused by plunger rod 19, the operator will push handle 42 upwardly thereby elevating bracket 16 via pivot pin 23 and concomitantly urge the bracket against collar 20 thereby forcing plunger rod 12 upwardly. Elevation of handle 42 will be assisted by spring 32 as previously explained. As bracket 16 is elevated, connecting member 28 is also urged upwardly as are spring 30 and push member 36 resting thereon and which continued upward movement will cause the push member to be urged against the bottom or lower surface of block 40 thereby also elevating the block and concomitantly attached sleeve 26 and spacer control rod 14 via pin 24 and the frictional engagement of composition 22 secured around the rod and engaging sleeve 26. As this elevation of block 40 is continued with the block elevation assembly consisting of connecting member 28, spring 30 and push member 36 being urged upwardly against the block, pawl 60 engages a tooth on the lower surface of rack 52 thereby pushing the rack to the left observing FIG. 3. The upper travel of block and the travel of the rack will terminate simultaneously when edge 61 of pawl 60 has stopped against stop plate 53. Adjustable stop screw 44 should abut against meet stop peg 46, the latter secured to and extending downwardly from plate 35 as is illustrated in FIG. 2 to assist in maintaining a level stop position of block 40 by properly adjusting the length of adjustable stop screw 44 as it is threadedly engaged in the forward end portion of block member 40. Alternatively, this top position may also be accomplished by providing stop peg 46 with threaded engagement in plate 35. Moreover, there may also be provided a stop means for limiting the upward travel of arm 42 on the arm and cooperating with the frame of the apparatus or some other suitable means which will be understood by those skilled in the art. Again, as block member 40 is urged upwardly, pawl 60 will continue to force rack 52 to the left as it travels within horizontal upper frame member 33 until the pawl stops against stop plate 53.

The extent of travel of rack or ratchet member 52, i.e., the distance which it is displaced or pushed by each cycle between letters as the handle is moved upwardly during that portion of the printing cycle, will depend on and can be adjusted or varied by selecting the elevation of space control rod 14. Accordingly, by rotating the space control rod so that pin 24 is at the low end of slot 25, this will cause depression or lowering of rod 14 with respect to block 40. This feature can be observed in FIG. 2. Such a lowering of the position of rod 14, will cause rod end 15 to contact the surface within type case 31 and beneath orifice 27 thereby limiting or reducing the distance of depression or lowering that can be achieved with block 40. In turn, with the reduction of the distance that block 40 will travel downwardly during the printing cycle as handle 42 is depressed, this will also limit the distance of retraction of pawl 60. Although the pawl is being urged to the right by biasing spring 58 during depression or downward travel of block 40, since the block is now being limited to the extent it can travel downwardly, it will concomitantly allow pawl edge 61 to pass over only a selected number of rack teeth. Since these teeth are spaced at regular and predetermined distance from one another, and since in the upward or elevation cycle of the apparatus the rack will only be pushed along at an interval or length corresponding to the number of the extent or teeth the pawl edge had passed over on its return during the previous downward cycle, it will be evident that the distance in each cycle at which the ratchet can be pushed by the pawl member is determined by the elevation of space rod control 14 along slot 25 of sleeve 26. Further, if the space control rod is rotated so that it is elevated to the maximum extent via pin 24 in slot 25 of the sleeves, on the downward cycle of the printing operation, end 15 of rod 14 will not contact the surface beneath orifice 27 until rod 14 had traveled downwardly a greater distance as compared to the distance it will travel if the rod was lowered relative to sleeve 26 and block 40. Accordingly, with the space control rod adjusted to its maximum elevation with respect to sleeve 26 and block 40, it will allow for maximum downward depression or travel of block 40 during the downward cycle of the apparatus whereby pawl 60 will pass over a maximum selected number of teeth on rack or ratchet member 52 during the drop or depression of block 40 in the downward cycle. This condition will then cause the pawl to push or displace the ratchet to the left observing FIG. 3 to the maximum extent thereby significantly increasing the distance between adjacent letters since this displacement of the ratchet member causes the same lateral displacement of arm 64 and attached platen 66. Again, this platen displacement will be realized since it is secured directly to arm 64 which is attached to the ratchet member. Accordingly, the displacement of the rack and platen between each letter or full cycle of the apparatus can be selected and determined by selecting the elevation of space control rod 14 with respect to sleeve 26 and block 40. An optional fine tuning adjustment of rod 14 can be made by adjustment of the end portion 15 of the rod which extends into the upper rod portion and is secured by a set screw 39 which threadedly engages rod 14 and may be tightened against the rod end 15. Other equivalent means to achieve this feature may also be used.

In such an apparatus it may be useful to also include an index scale to be used in combination with handle 54 so that a pointer or similar indicia on the handle will indicate the spacing between adjacent letters which will be achieved depending on the elevation of space control rod 14. Since the distance between regularly spaced teeth on the rack can be readily determined, handle 54 can be turned so that the pawl will pass over the number of teeth equal to the distance it is desired to move the platen between adjacent letters. Such an embodiment and the advantages thereof will be understood to those skilled in the art.

Various components in the preferred embodiment described hereinabove may be modified to any extent so that the apparatus will function in substantially the manner described but which modifications will remain within the purview of the invention. For example, spring 30 utilized between the connecting member 28 and push member 36 is for the purpose of somewhat buffering the communication of these components with block 40 during the upward cycle. However, such a feature is optional and other means for achieving this purpose may be obtained. Moreover, it will be noted that guide rod 34 should be positioned on block 40 so that it is approximately centrally located along the length of the block so that as push member 36 urges the block upwardly, it will do so at approximately the center of the mass of the block thereby preventing tilting of the block and possible binding or friction, for example, between guide rod 50 in slot 57 or the rods 12 and 14 in their respective slots. Moreover, the placement of the biasing spring for handle 42 and/or pawl member 60 are not particularly critical nor is the means by which they are attached to the apparatus, so long as their desired function is satisfactorily achieved. Further, although the preferred embodiment described uses a pawl and a toothed ratchet for advancing the platen, other equivalent means incorporating frictionally engaging members may be substituted therefore. Other modifications to the apparatus to achieve the functioning of the apparatus as indicated herein is also intended to be within the purview of the invention as will be evident to those skilled in the art.

I claim:

1. In a printing apparatus having a movable platen for securing a material to be printed on and a type case positioned above said platen and enclosing a plurality of types for printing on said material, the improvement comprising:

a first reciprocating rod having a lower end for being received in a selected one of a plurality of first type case cover orifices and actuating one of said types when said rod is depressed;

a second reciprocating rod having a lower end for being received in a selected one of a plurality of second type case cover orifices and means for adjusting the elevation of said second rod;

handle means for reciprocally depressing and elevating the first and second rods;

a movable rack and a rigid arm member secured to both the rack and said movable platen whereby movement of said rack causes movement of said platen;

a retractable pawl cooperating with said handle means for being retracted along said rack when the handle is depressed and engaging and advancing said rack and concomitantly said arm and platen when said handle is elevated; and means cooperating between said pawl and said second rod whereby the retraction of said pawl along said rack is changed by adjusting the elevation of the second rod.

2. The apparatus of claim 1 wherein the rack has a plurality of teeth along a surface thereof for engaging the pawl.

3. The apparatus of claim 2 including a frame having an upper support for guiding the rack.

4. The apparatus of claim 3 including a bracket to which the handle is secured and means on the first rod for engaging the bracket and alternately elevating and depressing the rod as the handle and bracket are moved up and down respectively.

5. The apparatus of claim 4 including a block member movable upwardly and downwardly and supported along the frame and having a pair of slots therethrough for slidably receiving the first and second rods and the pawl being pivotally secured to the block member whereby downward travel thereof retracts the pawl along the rack and elevation thereof forces the pawl against the rack whereby the rack is advanced.

6. The apparatus of claim 5 wherein the second rod elevation adjusting means comprises a sleeve secured to the block member and through which the second rod movably extends, the sleeve having a slot terminating at a high end and a low end, a pin secured to the rod and received in the slot whereby the rod is adjustably elevated and lowered as the pin is moved along the slot.

7. The apparatus of claim 6 including means secured on the bracket for urging the bar upwardly as the handle and bracket are elevated.

8. The apparatus of claim 7 including biasing means secured to and extending between the pawl and the block member for retracting the pawl.

9. The apparatus of claim 7 including a biasing means secured to the handle for urging the handle in an elevated position.

10. The apparatus of claim 6 including a means cooperating between the second rod and sleeve for providing frictional engagement therebetween to maintain elevation adjustment.

11. The apparatus of claim 10 including a handle secured on the second rod for rotatably adjusting the elevation thereof and indexing means cooperating therewith for indicating the advance of the platen.

12. The apparatus of claim 6 including adjustable means extending between the block member and the frame for limiting the elevation of the block member.

* * * * *